US010745093B2

(12) United States Patent
Kohnen et al.

(10) Patent No.: US 10,745,093 B2
(45) Date of Patent: Aug. 18, 2020

(54) SWIMMING APPARATUS

(71) Applicants: William Kohnen, Claremont, CA (US); Henrick R. Kohnen, Claremont, CA (US)

(72) Inventors: William Kohnen, Claremont, CA (US); Henrick R. Kohnen, Claremont, CA (US)

( * ) Notice: Subject to any disclaimer, the term of this patent is extended or adjusted under 35 U.S.C. 154(b) by 0 days.

(21) Appl. No.: 16/052,469

(22) Filed: Aug. 1, 2018

(65) Prior Publication Data

US 2019/0039703 A1 Feb. 7, 2019

Related U.S. Application Data

(60) Provisional application No. 62/539,914, filed on Aug. 1, 2017.

(51) Int. Cl.

| | |
|---|---|
| ***B63C 11/49*** | (2006.01) |
| ***B63H 16/20*** | (2006.01) |
| ***B63B 34/00*** | (2020.01) |
| *B63B 34/50* | (2020.01) |

(52) U.S. Cl.

CPC ..... *B63C 11/49* (2013.01); *B63B 34/00* (2020.02); *B63H 16/20* (2013.01); *B63B 34/50* (2020.02); *B63H 2016/202* (2013.01)

(58) Field of Classification Search

CPC ..... B63C 11/49; B63H 16/20; B63B 35/74

See application file for complete search history.

(56) References Cited

U.S. PATENT DOCUMENTS

| | | | | |
|---|---|---|---|---|
| 5,237,952 | A * | 8/1993 | Rowe | B63B 11/04 114/332 |
| 6,033,276 | A * | 3/2000 | Han | B63C 11/49 114/315 |
| 6,524,145 | B1 * | 2/2003 | Arzate | A63B 35/02 114/315 |
| 7,131,389 | B1 * | 11/2006 | Hawkes | B63G 8/001 114/330 |
| 7,699,017 | B1 * | 4/2010 | Marshall | B63B 7/082 114/315 |
| 9,067,652 | B2 * | 6/2015 | Nanayakkara | B63B 32/60 |
| 10,071,792 | B2 * | 9/2018 | Montousse | B63C 11/46 |
| 2003/0045182 | A1 * | 3/2003 | Frasier | B63H 1/36 440/25 |
| 2013/0126666 | A1 * | 5/2013 | Brown | B60F 5/02 244/2 |
| 2014/0193206 | A1 * | 7/2014 | Montousse | B63G 8/001 405/185 |
| 2019/0039703 | A1 * | 2/2019 | Kohnen | B63H 16/20 |

* cited by examiner

*Primary Examiner* — S. Joseph Morano
*Assistant Examiner* — Jovon E Hayes

(57) ABSTRACT

Disclosed are systems, devices, and methods for swimming using a swimming apparatus that includes an exterior shell, optionally including a top half and bottom half and an opening to accommodate a propulsion system.

15 Claims, 11 Drawing Sheets

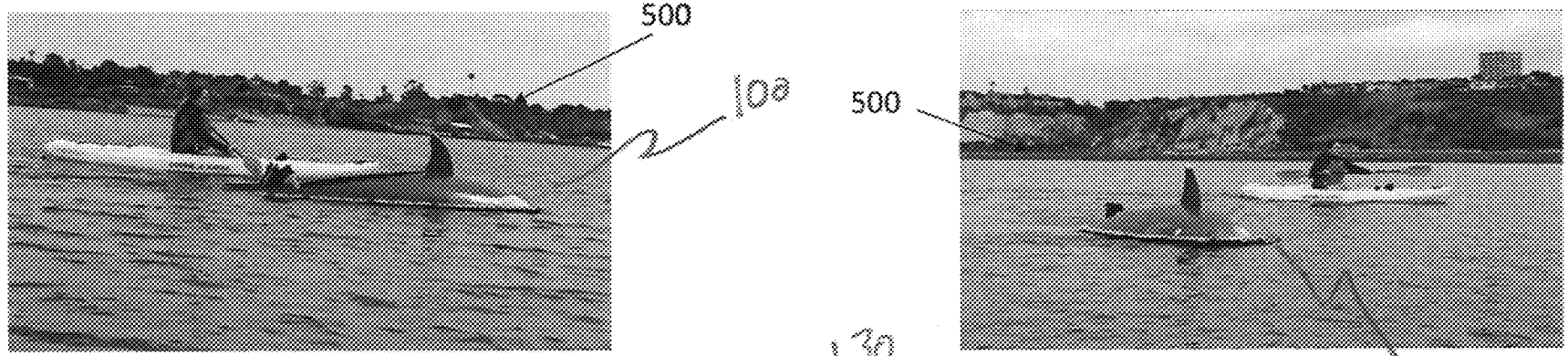
FIG. 5A
FIG. 5B
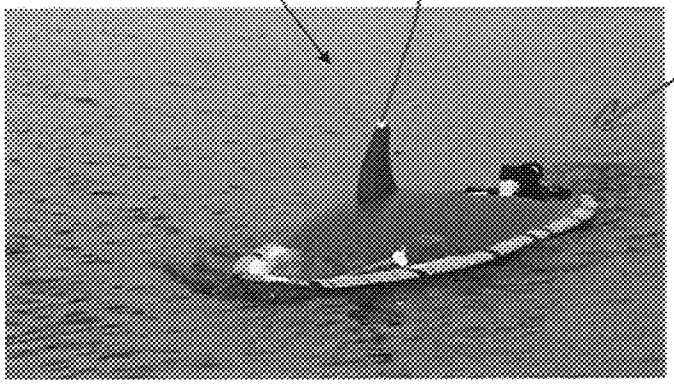
FIG. 5C 100
160
610
620
165
820

100
160
600B
630
165
820

800
640
600C
650
660
165
820

100
600D 100
600E
260

SWIMMING APPARATUS

This application has priority to U.S. Patent Application No. 62/539,914, filed Aug. 1, 2017 and titled, "Swimming Apparatus", which is referred to and incorporated herein in its entirety.

FIELD OF THE INVENTION

The present invention relates to snorkeling and diving gear.

BACKGROUND OF THE INVENTION

As one of the major aids used by the bare-handed diver when diving, the snorkel is designed to help the diver keep continued breathing while floating in the water to search for watching the underwater scene.

A typical snorkel is a generally J-shaped hollow tube made of rubber or plastic, often about 30-35 cm long with a caliber of about 1.5-2.0 cm. The bottom of the tube may be connected to a mouthpiece soft and suitable for its user. The top of the tube opens into a mouth suspended about water. A clip may be attached to the tube in order to join the snorkel to the mask. When floating up, the said mouth at the top end of the tube is configured to be above the water level, such that the diver can watch the underwater scene on the one hand and keep continued breathing through the snorkel on the other hand.

Using a conventional snorkel can be relatively simple. A clip usually fixed to the mask strap must also be fixed to the snorkel so that the snorkel is ready for positioning (usually near the ear). The mask is placed over the head to enclose the eyes and nose. Next, the mouthpiece is inserted into the mouth. Biting down on it usually aids in maintaining a smooth airflow. Now the user submerges face down in water. The snorkel tube top-end opening should protrude approximately 15 cm above the water surface. The user can then breathe through the snorkel while enjoying the underwater world.

The conventional snorkel therefore allows continuous breathing while swimming face down in the water. However, the opening at the top end of the snorkel easily allows sea water to enter. If the user looks to the right or left, the snorkel tilts with the user's head and get submerged in the water. Therefore, the conventional snorkel works best only when the user looks straights down, thus limiting the line of vision and preventing the user from enjoying the snorkeling experience. Further, even when the user is simply looking down, waves passing over the snorkel will immediately fill the snorkel with water and if the user fails to keep his or her head in a certain angle causing the snorkel's top opening to touch the water surface, the snorkel will become flooded causing the user to choke.

Further, when a user is snorkeling, the average user can only swim a certain distance before getting tired. In order to stop snorkeling and take a break, the user has to swim back to shore.

It is therefore desirable to provide a snorkeling apparatus that includes a floatation device that may include a port for the snorkel tube that does not get submerged in water and provides the user increased visibility into the water and a better snorkeling experience.

SUMMARY OF THE INVENTION

Disclosed are systems, devices, and methods for swimming using a swimming apparatus that includes a top half, wherein the top half comprises an opening, a bottom half, and an opening to accommodate a propulsion system.

In one aspect of the invention, a swimming apparatus in accordance with the invention is provided with a single or multi-piece exterior shell defining an interior space accommodating a swimmer, and a propulsion system is provided. Any form of propulsion system may be used, such as for example motorized, pedal powered, manual powered, or fins on the swimmer whereby the propulsion is provided by the swimmer moving one's legs. In one embodiment, the propulsion system incorporates a force input mechanism, such as a pedal, and a linkage transmitting the force from the force input mechanism to a propulsion drive, such as one or more fins or paddles.

In an alternative embodiment, the swimming apparatus includes an enclosure surrounding a passenger and an external propulsion source, such as a directed propeller or external diver.

In a further embodiment of the invention, a swimming apparatus is provided having an exterior shell defining an interior space accommodating a swimmer, and a fluid supply input such as an air supply providing air into the interior space defined within the swimming apparatus. The air optionally is provided into the interior space at a pressure that is above surrounding fluid pressure. The exterior shell also may define an aperture at or adjacent its bottom side. The air supply input optionally provides air into the interior space at a pressure that is above the surrounding fluid pressure, such as to maintain a pressure gradient if desired.

This summary and the following detailed description are merely exemplary, illustrative, and explanatory, and are not intended to limit, but to provide further explanation of the invention as claimed. Other systems, methods, features, and advantages of the example embodiments will be or will become apparent to one skilled in the art upon examination of the following figures and detailed description.

BRIEF DESCRIPTION OF THE DRAWINGS

The details of the subject matter set forth herein, both as to its structure and operation, may be apparent by study of the accompanying figures, in which like reference numerals refer to like parts. The components in the figures are not necessarily to scale, emphasis instead being placed upon illustrating the principles of the subject matter. Moreover, all illustrations are intended to convey concepts, where relative sizes, shapes and other detailed attributes may be illustrated schematically rather than literally or precisely. Illustrated in the accompanying drawing(s) is at least one of the best mode embodiments of the present invention.

FIGS. 5A, 5B, and 5C illustrate perspective views of a swimming apparatus in use, according to some embodiments of the present invention.

DETAILED DESCRIPTION

Figure 1:
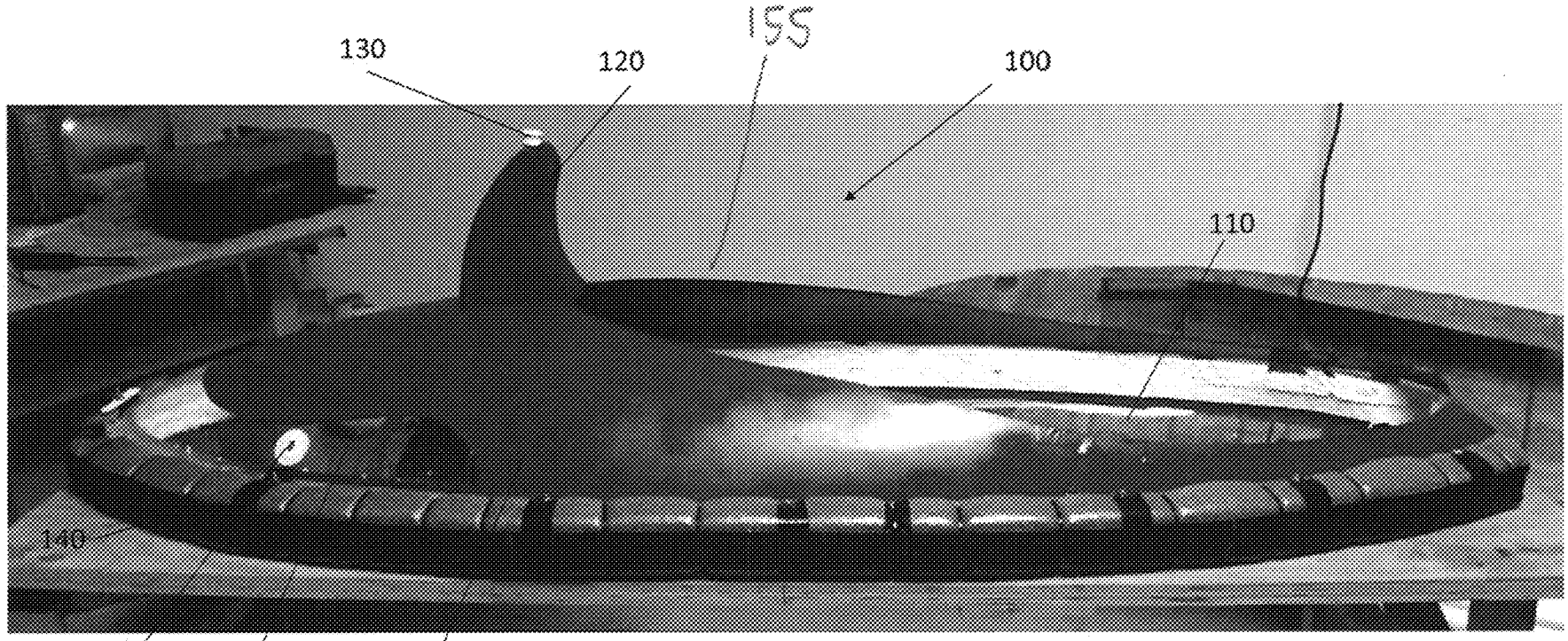
FIG. 1 illustrates a side view of a swimming apparatus, according to exemplary embodiments of the present invention.
Figure 2B:
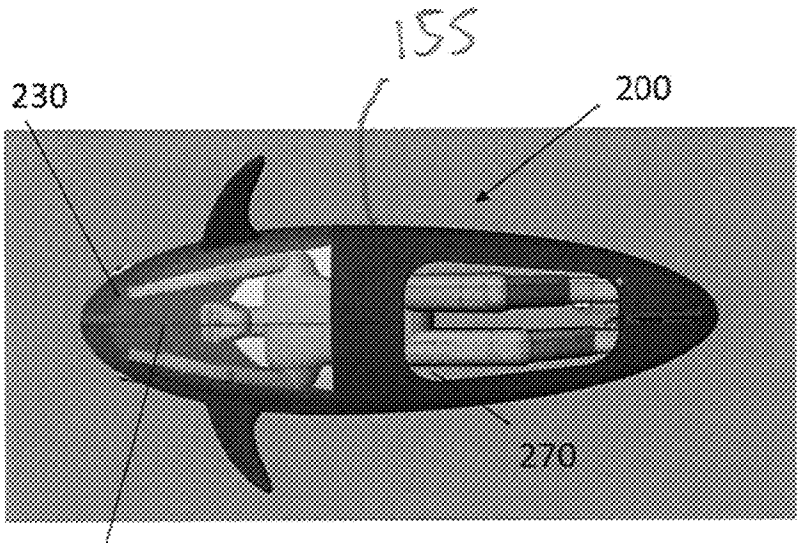
FIG. 2B illustrates a bottom view of a swimming apparatus, according to exemplary embodiments of the present invention.
Figure 2A:
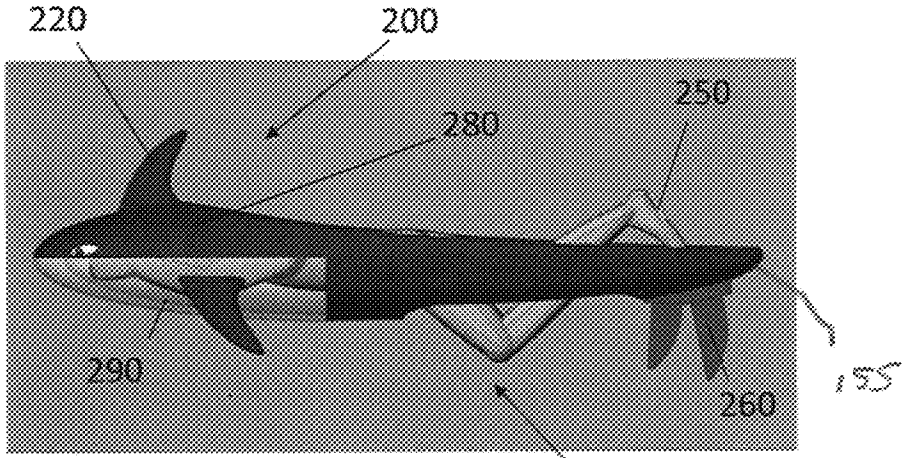
FIG. 2A illustrates a side view of a swimming apparatus, according to exemplary embodiments of the present invention.
Figure 2D:
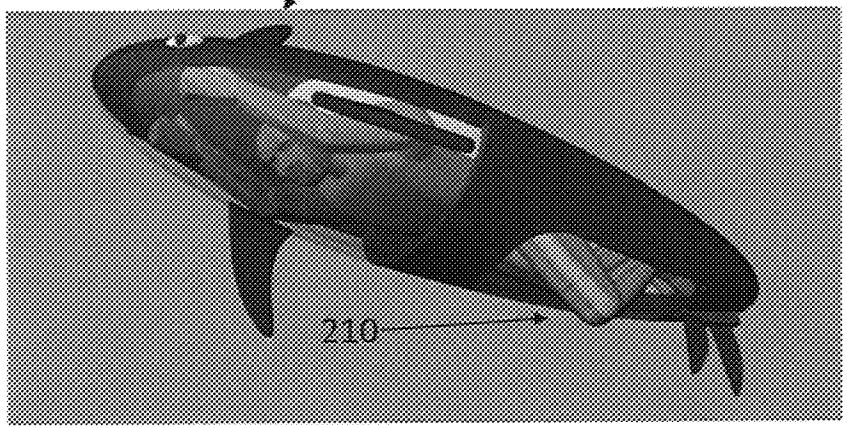
FIG. 2D illustrates a bottom view of a swimming apparatus, according to exemplary embodiments of the present invention.
Figure 2C:
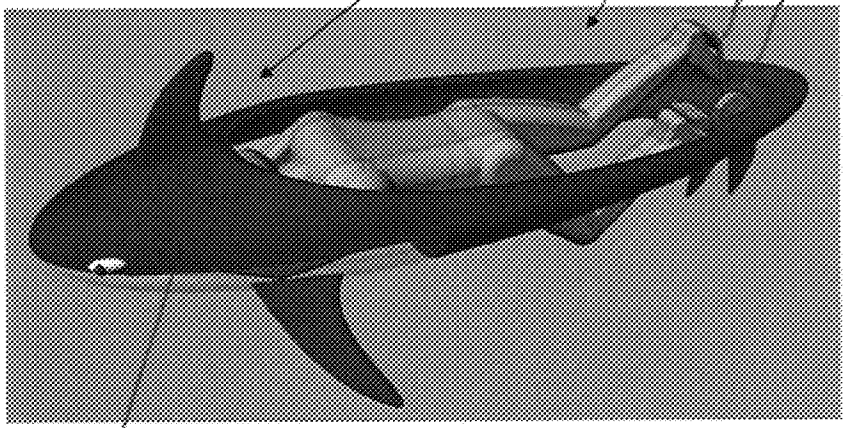
FIG. 2C illustrates a side view of a swimming apparatus, according to exemplary embodiments of the present invention.
Figure 2E:
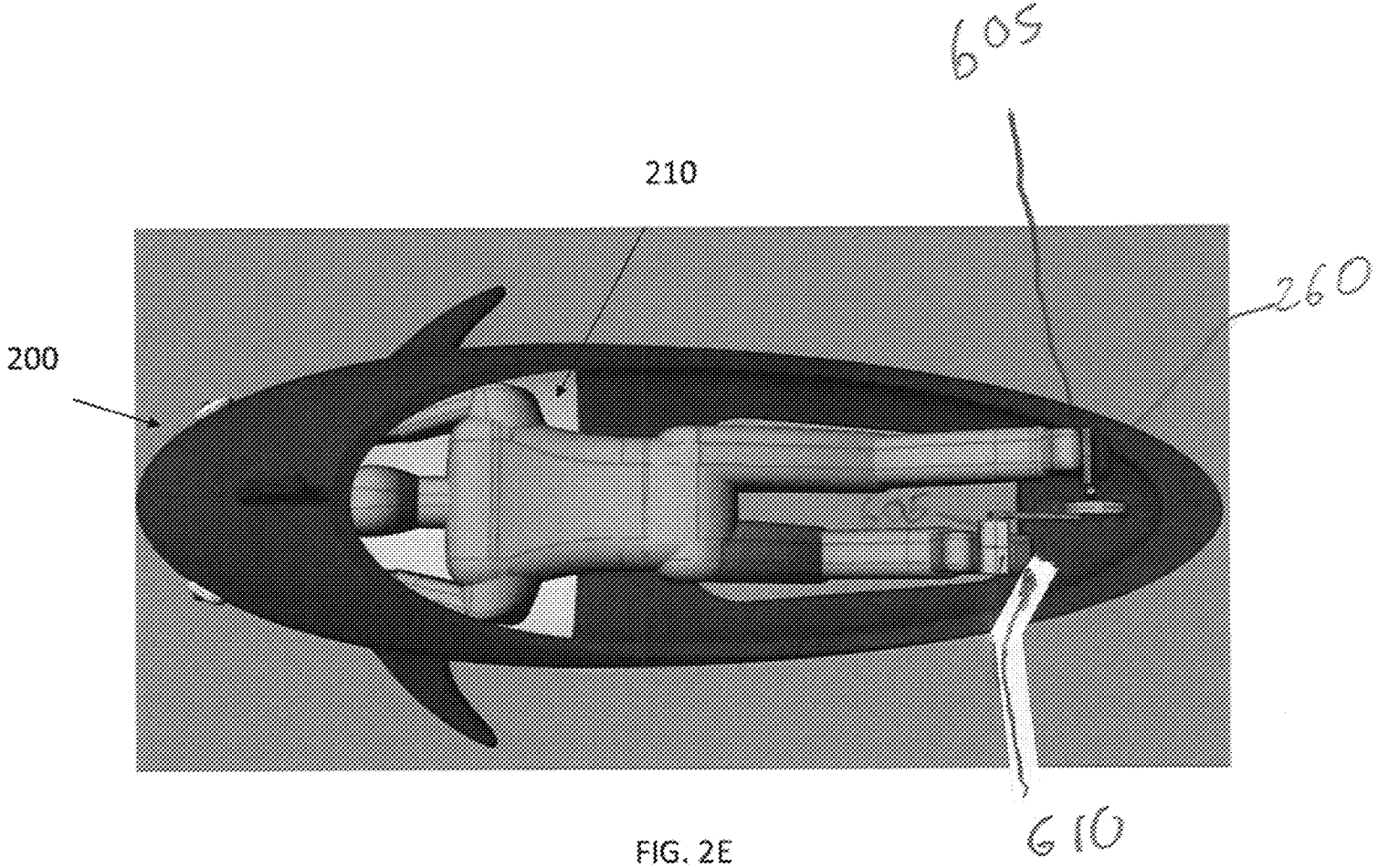
FIG. 2E illustrates a top view of a swimming apparatus, according to exemplary embodiments of the present invention.

Before the present subject matter is described in detail, it is to be understood that this disclosure is not limited to the particular embodiments described, as such may vary. It should also be understood that the terminology used herein is for the purpose of describing particular embodiments only, and is not intended to be limiting, since the scope of the present disclosure will be limited only by the appended claims. While this invention is susceptible to different embodiments in different forms, there is shown in the drawings and will here be described in detail a preferred embodiment of the invention with the understanding that the present disclosure is to be considered as an exemplification of the principles of the invention and is not intended to limit the broad aspect of the invention to the embodiment illustrated. All features, elements, components, functions, and steps described with respect to any embodiment provided herein are intended to be freely combinable and substitutable with those from any other embodiment unless otherwise stated. Therefore, it should be understood that what is illustrated is set forth only for the purposes of example and should not be taken as a limitation on the scope of the present invention.

In the following description and in the figures, like elements are identified with like reference numerals. The use of "e.g.," "etc.," and "or" indicates non-exclusive alternatives without limitation, unless otherwise noted. The use of "including" or "includes" means "including, but not limited to," or "includes, but not limited to," unless otherwise noted.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" can refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

Turning to the figures, FIG. 1 illustrates a swimming apparatus 100 (as used herein, swimming apparatus 100 also refers to the swimming apparatus as noted with reference numbers 200, 300, 400, 500, 600, 800 in other figures). The swimming apparatus 100 includes an exterior shell 155. The exterior shell can be of any assembly providing sufficient structural support for the swimming apparatus 100 to accommodate a swimmer 210 and to support other structural elements such as fins, motors etc. In an illustrated embodiment the swimming apparatus includes both a top portion (also referred to as "top half) 160 and a bottom portion such as illustrated in FIGS. 4 and 6A-C (also referred to as "bottom portion") 165. In some embodiments, the swimming apparatus 100 may be ellipsoidal. In other embodiments, the swimming apparatus 100 may be rectangular, triangular, or any other shape. The swimming apparatus 100 may be able to hold one or more swimmers at the same time inside the inner chamber 110. In some embodiments, the bottom half may generally be underwater. In other embodiments, the bottom half may be partially under water. In yet other embodiments, the bottom half may be on the surface of the water. In some embodiments, the top half 160 may generally be underwater. In other embodiments, the top half 160 may be partially under water. In yet other embodiments, the top half 160 may just brush the surface of the water. The swimming apparatus 100 may have a separate buoyancy element(s) 140 attached to either the top half 160, bottom half, both halves, or in between the top half 160 and bottom half. In one embodiment, the buoyancy elements are made of foam 140. In some embodiments, the swimming apparatus 100 floats and is free flooded. In such embodiments, the swimmer may float inside the swimming apparatus 100.

The swimmer may also need a mask. In other embodiments, the interior 110 of the swimming apparatus 100 may be dry, in which case the swimmer may not be required to wear a snorkel mask. In some embodiments, the swimming apparatus 100 may be positively buoyant. In other embodiments, the swimming apparatus 100 can be neutrally buoyant. In some embodiments, the swimmer may be able to stand inside the swimming apparatus 100 and through the swimming apparatus 100 while it floats. The swimmer may be able to easily direct and point the apparatus when standing in shallow water. In some embodiments, while the swimmer is laying inside the swimming apparatus 100, he or she may wear a snorkeling mask. It is preferable that the swimmer be floating inside in order to off-load the weight of the body. Particularly to off-load the weight of the head when laying in a prone position—a position that can become very uncomfortable in a short time when in a dry environment and the neck muscles must hold the head up. The wet and dry options may keep the full range open—but the wet option may also have a specific advantage that allows swimmers to drive in comfort for a long time. While the swimmer is laying inside the swimming apparatus 100, he or she may be floating inside the swimming apparatus 100. In other embodiments, the swimmer may just lay inside the swimming apparatus 100. The swimming apparatus 100 may or may not assist in the swimmer's buoyancy. In some embodiments, due to the shape of the swimming apparatus 100, such as the exemplary ellipsoidal shape that resembles a shark illustrated in FIG. 1, the swimming apparatus 100 may provide roll and pitch stability to the swimmer. In some embodiments, the swimming apparatus 100 can provide helpful buoyancy assist to carry features, accessories, breathing components, and propulsion elements at least within the inner chamber 110.

The inner chamber 110 may also provide enough space for the swimmer to wear, remove, and/or adjust any accessories, such as corrective lenses. In some embodiments, the bottom half 165 of the swimming apparatus 100 may be completely transparent or translucent such that it provided a clear visibility primarily downwards to see the sea life. In other embodiments, the bottom half 165 may be partially transparent. In other embodiments, the bottom half 165 may be completely opaque or completely translucent. In some embodiments, the top half 160 may be painted opaque. The top half 160 may also be covered using any other form of covering that makes it opaque including but not limited to stickers, wraps, etc. In some embodiments, the top half 160 may be completely transparent or translucent. In other embodiments, the top half 160 may also be partially transparent or translucent. In some embodiments, the top half 160 may be partially transparent or translucent, such as the section 150 illustrated in FIG. 1, so as to allow the swimmer to look straight ahead and assess any hurdles to the swimming path. The inner chamber 110 may provide sufficient space to the swimmer to operate controls for navigation as well as operating cameras or other personal devices. In some embodiments, the swimming apparatus 100 may provide a dash for support or holding space for swimmer to carry waterproof accessories. In other embodiments, the swimming apparatus 100 may contain a waterproof holder to hold the accessories of the swimmer, such as cameras, phones, etc.

In some embodiments, the swimming apparatus 100 may provide a structure for a propulsion system 260 operated by the swimmer. In an alternative embodiment, no propulsion system is provided and the swimmer 210 can move the swimming apparatus, such as by kicking or using foot fins, or by an external swimmer (not shown). The propulsion system can be manual or pedal 605 (human) powered or mechanically powered, with a force input device such as a manual crank or a foot pedal, or a hand operated pedal. While the swimmer is within the swimming apparatus 100, he or she will need to breathe. The air supply may be manual via a snorkel or it may be through a scuba tank and regulator. The snorkel tube may pass through the snorkel mount 130 and into the air above the water. In some embodiments, the snorkel mount 130 may be located at the highest point of the shape of the swimming apparatus 100. For example, in the exemplary ellipsoidal shape that resembles a shark, as illustrated in FIG. 1, the snorkel mount 130 may be located on the dorsal fin 120. The snorkel mount 130 may also be located at any other location on the swimming apparatus 100 that is convenient to the swimmer. In some embodiments, the swimming apparatus 100 may provide the structure to integrate guidance fins to control the swimming direction. In some embodiments, the swimming apparatus 100 may provide the structure to include a keel fin for directional stability. The length of the swimming apparatus 100 may be adjustable depending on the needs of the user. The swimming apparatus 100 may include additional design features, such as eyes 170. The design features, such as eye 170, may also serve dual purposes, such as providing both an aesthetic feature and an outlet for excess water that enters the inner chamber 110.

FIGS. 2A-2E illustrate a swimming apparatus 200 with a swimmer 210. The swimming apparatus 200 may be similar to any of the various embodiments described for swimming apparatus 100 (and the other reference numbers used for the swimming apparatus herein). In some embodiments, the swimmer 210 may be partially exposed to the water through an open bottom section 270. In other embodiments, the swimmer 210 may be completely insulated from the water. In some embodiments, the bottom section 270 may be closed off. In some embodiments, the swimmer 210 may be required to hold the swimming apparatus 200 at the front through holders 230. In other embodiments, the holders 230 may be located anywhere else on the swimming apparatus 200 that may be held using any body part. In some embodiments, the swimming apparatus 200 may not have any holder 230. In some embodiments, the top half 280 of the swimming apparatus 200 may be partially open to allow the swimmer 210 to enter. In some embodiments, the top half 280 of the swimming apparatus 200 may be completely closed. In other embodiments, the top half 280 of the swimming apparatus may be closed before or after the user enters the swimming apparatus 200. In some embodiments, the top half 280 provides a structure to offer shade to the swimmer's head and torso. In some embodiments, the top half 280 may provide a structure to hold the snorkel out of the water with a mounting element. In other embodiments, the top half 280 may provide a structure to hold scuba hear. The snorkel mount can be in the shape of a shark dorsal fin or other fish dorsal fin. The front part of the top half 280 may be open. In some embodiments, there may be no top half 280 and instead the mounting element may be added to the bottom half 290 to hold the snorkel. The top half 280 may or may not be buoyant and can have buoyant material added/attached to it to float. The buoyancy may also be provided through an inflatable chamber that can be placed inside or outside or between the top half 280 and bottom half 290 of the swimming apparatus 100. The inflatable chamber or foam may be placed between the two hull sections. One advantage of including an inflatable chamber is to reduce the total height of the apparatus for storage and/or transport. In some embodiments, the top entry opening can extend such that the swimming apparatus's 200 structure is fully open at the back. In some embodiments, the rear part may also provide part of the structure to which the propulsion system 260 can be attached. In some embodiments, the propulsion system 260 may just be a pair of swimmer fins. In other systems, the propulsion system 260 may be a mechanical setup that may be powered manually or through a motor. The front section of the top half 280 may provide some viewing window for the swimmer 210 to see above and to the side of the water surface. The upper viewing window may be an open hole or a window. The front top half section can be of clear, transparent material, or the entire top half 280 can be made of a clear, transparent material. In other embodiments, the entire top half 280 may be completely opaque and/or translucent. The top half 280 half may be painted and/or partially or completely made of colored material, or transparent material. The top half 280 may be made of rigid and/or flexible material. The top half 280 may be completely or partially collapsible. The top half may be molded in specific dish or creature shapes. The bottom half 290 may provide a surrounding structure around the swimmer. The bottom half 290 may be buoyant or may have buoyant material added/attached to it to float. The bottom half 290 may have an opening at the rear for the swimmer to enter. The bottom half 290 may have a rear opening 270 that may allow for the swimmer's 210 legs to be free to operate the propulsion system 260. The rear entry hole can extend such that the swimmer apparatus's 200 structure is fully open at the back. The rear entry hole may provide a ledge on which the swimmer can sit upright. In some embodiments, the bottom half 290 may not have a rear opening 270 such that the bottom half 290 is completely insulated from the material, thereby allowing the swimmer to not wear a snorkel mask. The swimmer may just wear his or her corrective lenses and be able to snorkel. In some embodiments, the rear part may provide a structure to which the propulsion system 260 can be attached. The front section of the bottom half 290 provides a viewing window 240 for the swimmer. The viewing window 240 may be an open hole or a window (round, elliptical, square or rectangular). In some embodiments, the front bottom half hull can be of clear material, or the entire bottom half can be made of clear material. In some embodiments, the bottom half 290 may be made of completely opaque and/or translucent material. In some embodiments, the bottom half 290 can be painted and/or partially or completely made of colored material, or transparent material. The bottom half 290 may be molded into specific fish or creature shapes.

Figure 3B:
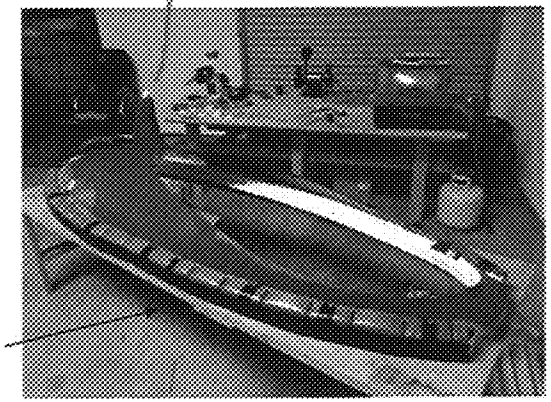
FIG. 3B illustrates a side view of a swimming apparatus, according to exemplary embodiments of the present invention.
Figure 3D:
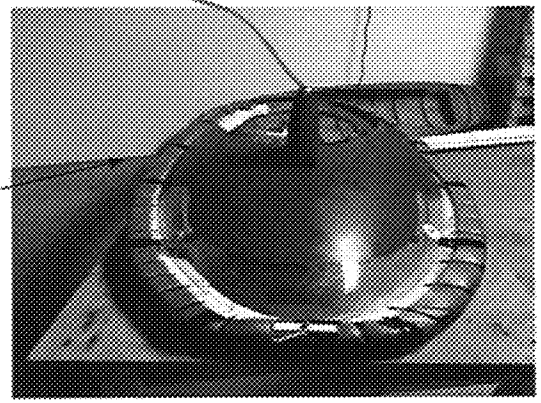
FIG. 3D illustrates a front view of a swimming apparatus, according to exemplary embodiments of the present invention.
Figure 3A:
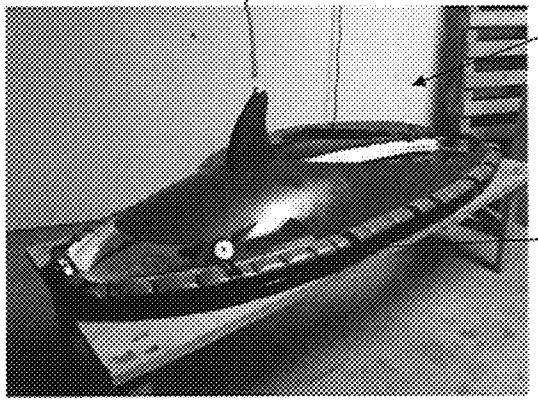
FIG. 3A illustrates a side view of a swimming apparatus, according to exemplary embodiments of the present invention.
Figure 3C:
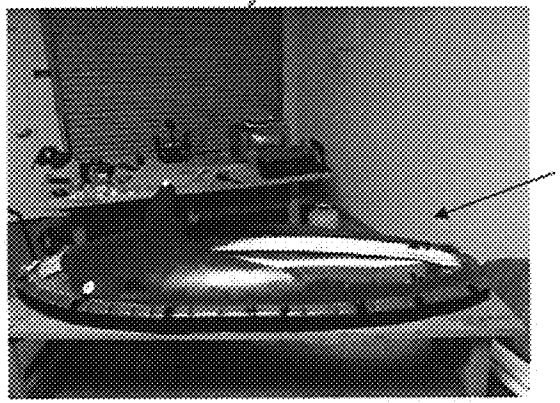
FIG. 3C illustrates a side view of a swimming apparatus, according to exemplary embodiments of the present invention.
Figure 3E:
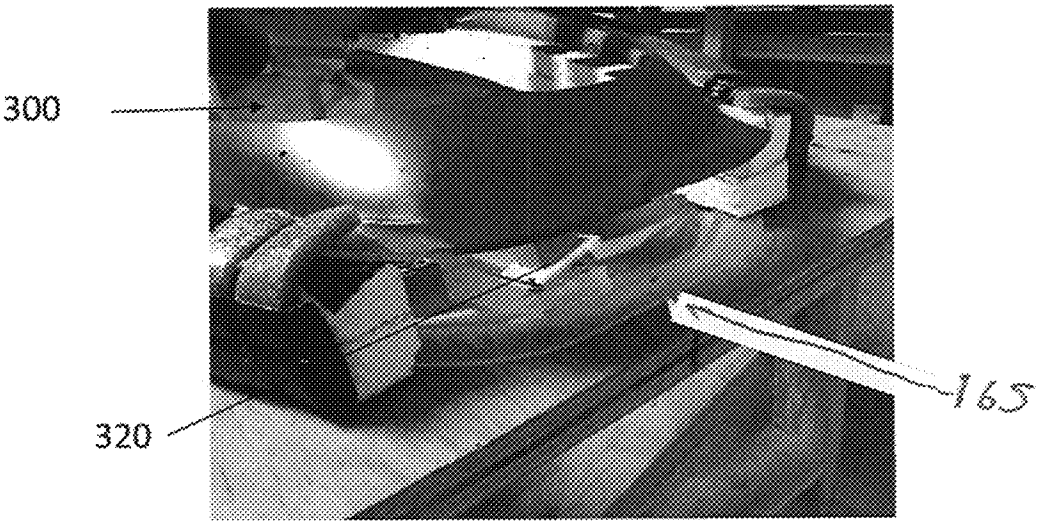
FIG. 3E illustrates the backside of a swimming apparatus, according to exemplary embodiments of the present invention.

FIGS. 3A-3E illustrate various views of the swimmier apparatus 300, which may be similar to various embodiments described for swimming apparatuses 100 and 200, and the other reference numbers used herein for the swimming apparatus. As can be seen the swimming apparatus has a buoyancy element 310 attached in between the top half and the bottom half. The buoyancy element 310, such as foam, may be added to the structure at the water level to increase the swimming apparatus's 300 buoyancy. The buoyancy element 310 may be fixed to the top, to the bottom, or both, or the three elements can be disconnected for simpler transportation. The buoyancy element 310 can be made of foam or from a buoyant molded structure or from an inflatable chamber. The buoyancy element 310 may provide storage area for swimmer accessories, utility accessories, propulsion accessories, and batteries. The buoyancy element 310 may be molded in specific fish or creature shapes. The buoyancy element 310 may be located at the bottom, middle or top of the apparatus to control the depth of the swimmer and apparatus below the waterline. The buoyancy element 310 may be composed of one or more sections. In some embodiments, the swimming apparatus 300 may be made without the buoyancy element 310 for submerged operation. The swimming apparatus 300 may be made with one or more sealed air cells for buoyancy. The swimming apparatus 300 may also have a water exit port 320 located at the back of it, as illustrated in FIG. 3E. The water exit port 320 may also be located at any other location of the swimming apparatus 300.

Figure 4:
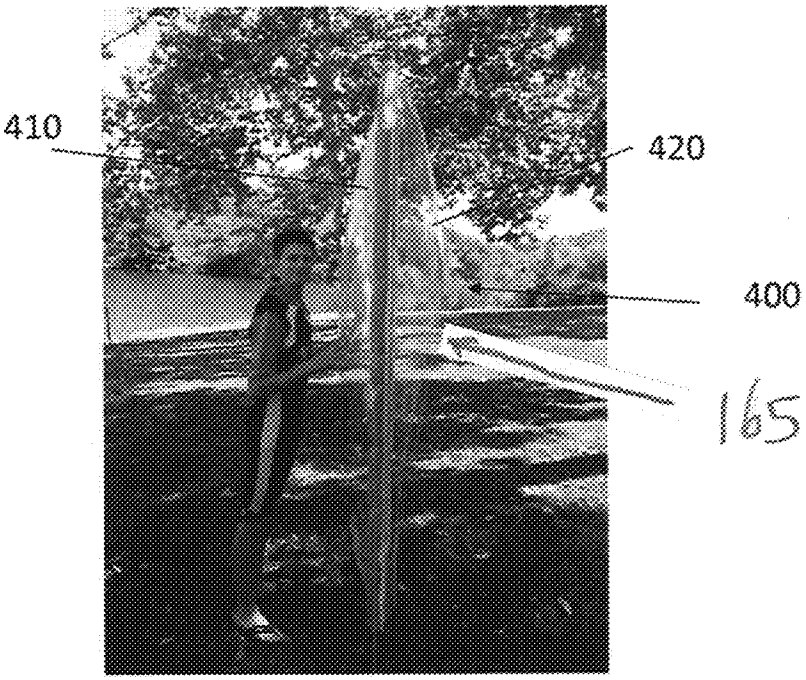
FIG. 4 illustrates a side view of a swimming apparatus, according to exemplary embodiments of the present invention.

FIG. 4 illustrates a swimming apparatus 400 with both the top half 410 and the bottom half 165, 420 made of clear, transparent material.

As illustrated in FIGS. 5A-5C, the swimming apparatus 500 (and the other reference numbers used herein for the swimming apparatus) may include one or more viewing windows to see the seafloor and also maybe see ahead while the swimmer is swimming so that he or she can avoid collisions with other objects on the water such as a canoe, as illustrated in FIGS. 5A-5B. The swimmer may wear a snorkel mask when the swimming apparatus 500 is free flooded. The top half may provide shade to eliminate any reflections that reduce the visibility, as is typical in windows mounted on surface floating boards. In some embodiments, the swimmer may look though the water in the swimming apparatus 500 and thru the clear window onto the seafloor below. The swimming apparatus 500 provides a structure to hold a snorkel apparatus out of the water where it is stable and unobstructed access to air regardless of the swimmer's head movement. The weight and complexity of the snorkel element may not be limited to what the swimmer can support by his mask alone. The snorkel may be integrated as part of the dorsal fin on top of the apparatus. The snorkel may be of simple open tube type or integrated as a water proof valve at the opening. The snorkel air supply to the swimmer may be a single hose or an integrated dual channel air supply where one channel brings in fresh air and the second channel provides exhaust air. The exhaust channel may exit in the water, at the water surface, or above the water line. The air supply may be provided with a flexible hose that allows the swimmer to move the head for free observation downwards, forward, and sideways (for surface traffic). The snorkel hose may be made long enough to insert the snorkel mouth piece while above the water, or may be inserted in the water. The swimmer may use a simple snorkel mask or a full-face mask. The swimming apparatus 500 may have none or at least one dorsal fins for snorkel support. The swimming apparatus 500 may have one or more snorkels for one or more swimmers. In some embodiments, the snorkels may be located anywhere along the apparatus. In some embodiments, the swimmer may use a full-face mask for better visibility and less contact with the water. The snorkel system may provide sufficient hose length to put on the mask while above the water, before laying down in the vehicle. With a full-face mask, the swimming apparatus 500 can be equipped with a communication system permitting the swimmer to talk to another person. The swimmer may use a waterproof mobile phone to talk to another person. In some embodiments, the swimming apparatus 500 may be equipped with communication mechanism can talk to each other while swimming.

Figures 6A, 6B, 6C, 6D, 6E:
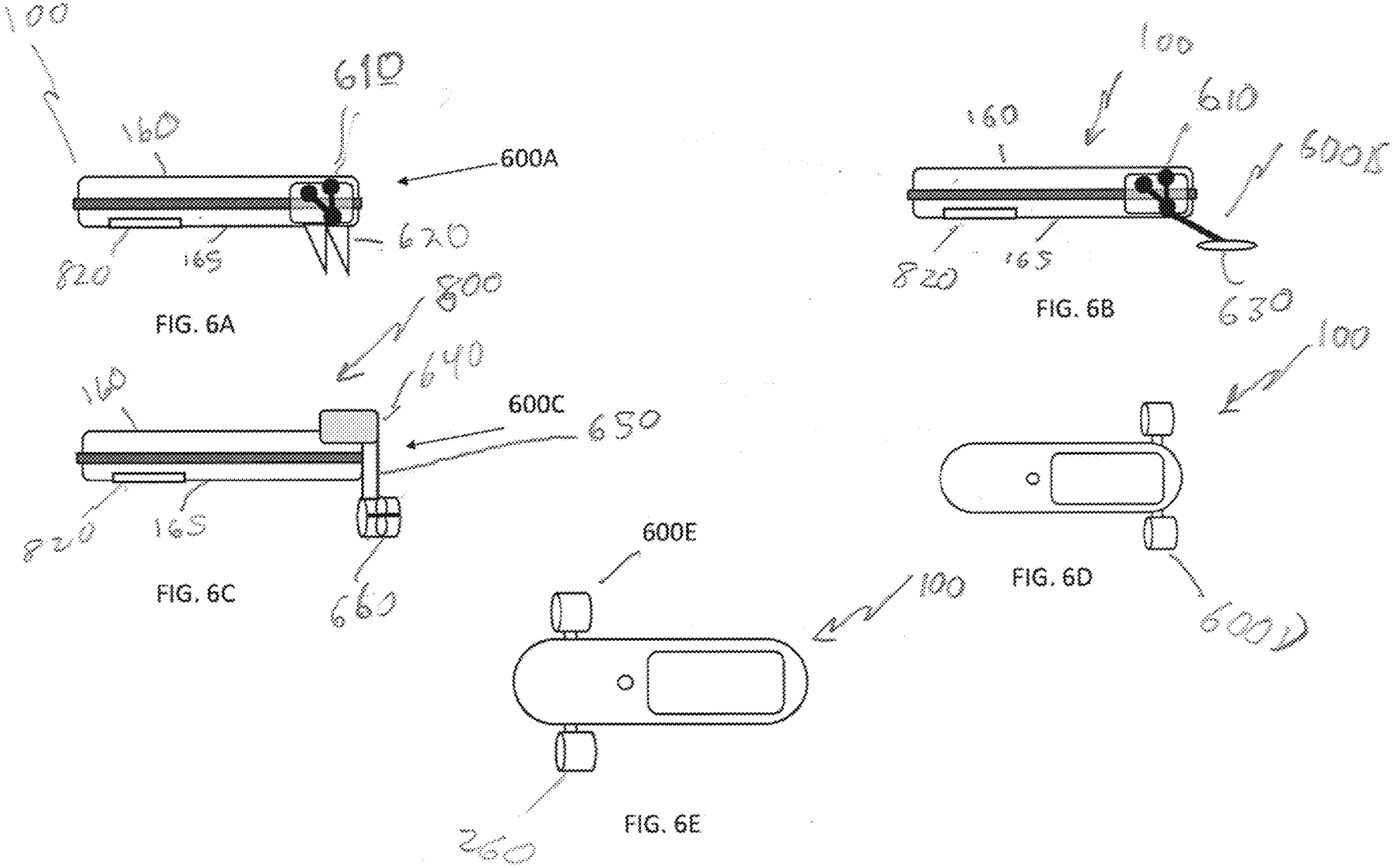
FIGS. 6A, 6B, 6C, 6D, and 6E illustrate perspective views of various propellers used in a swimming apparatus, according to some embodiments of the present invention.

FIGS. 6A-6E illustrate various propulsion systems. FIG. 6A illustrates a Manual Fin Drive propulsion system 600C, in which the swimmer 210 optionally operates a fin drive system by operating force input device, such as a pedal or crank 605 driven linkage 610 driving fins or paddles 620. FIG. 6B illustrates a Manual Reciprocating Drive propulsion system 600B, which also optionally includes a linkage 610 that can be operated by hand or foot to drive propulsion device 630. FIG. 6C illustrates a propeller manual (or foot operated) or motorized propulsion system 600C, including an optional motor 640, drive shaft 650 (optionally enclosed) and propeller 660. The propeller 660 may optionally include dual propellers, such as illustrated in FIGS. 6D and 6E. FIG. 6D illustrates the optional motor 640 as an Electric Propulsion system 600D at rear. FIG. 6E illustrates an Electrical Propulsion system 600D at front 600E. These propulsion systems may be used with any swimming apparatus. The swimming apparatus may be operated with a human powered propulsion device. The propulsion system may include opposing dual fin propulsors, propellers, reciprocal displacement fins or jet systems. The propulsion system may also be mechanically operated by a combustion engine or electric motors. The swimming apparatus may have one or more propulsion systems. The propulsion systems may be located at the rear of the swimming apparatus or anywhere else along the swimming apparatus's waterline. The propulsion system controls may be located at the front where the swimmer's hands can reach them. In other embodiments, the propulsion systems controls may be located at a location that is accessible by the user using any other body part. In other embodiments, the propulsion systems controller may be accessible by other people as well so as to facilitate remote access. These controls may be sealed devices or water tolerant controls. The propulsion system may propel the swimming apparatus through its centerline or symmetrically on each side. The propulsion system may provide single direction or bi-directional thrust. The thrust from the propulsion system may be transferred thru the apparatus structure or through the swimmer to the swimming apparatus. The propulsion system in its simplest form may be an open space at the rear of the apparatus to allow the swimmer to push the vehicle with standard swimming fins. The swimmer may be connected to the swimming apparatus through his or her weight, the control handles or by a mechanical attachment/harness or any combination thereof. The swimming apparatus may integrate either human powered propulsion or mechanical propulsion or both at the same time. The propulsion systems may be used to direct the swimming apparatus, especially in case of electric propulsion systems that may offer multiple thrusters and that may be reversible. In some embodiments, the swimming apparatus with communication and GPS capability and mechanical or electrical propulsion may be equipped with auto-heading, auto pilot or station keeping capability via mobile phone or specialty control device. In other embodiments, submersible swimming apparatus configurations may be equipped with multiple thrusters including control in the vertical direction. The swimming apparatus may be equipped with sealed combustion engines and propeller or jet drives. The swimming apparatus provides a tow point and can be towed by a secondary vehicle.

Figure 7B:
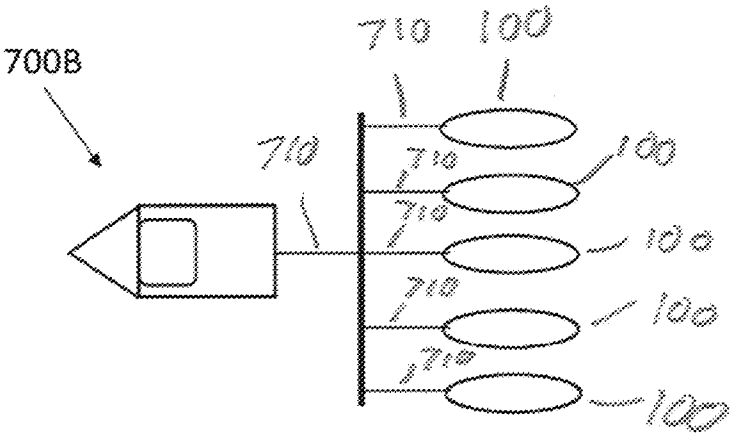
FIGS. 7A and 7B illustrate perspective views of a towing mechanism, according to some embodiments of the present invention.
Figure 7A:
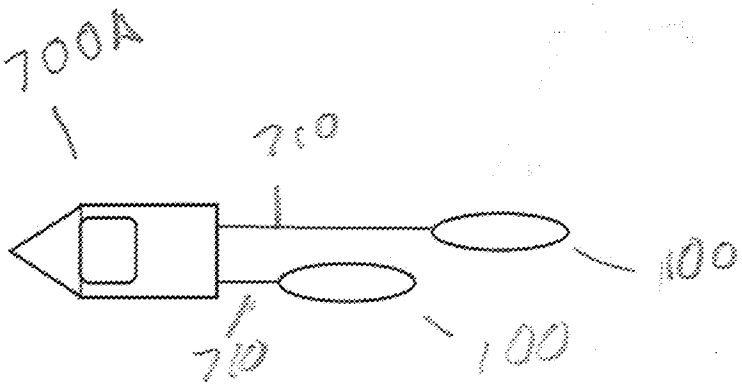
Figure 8:
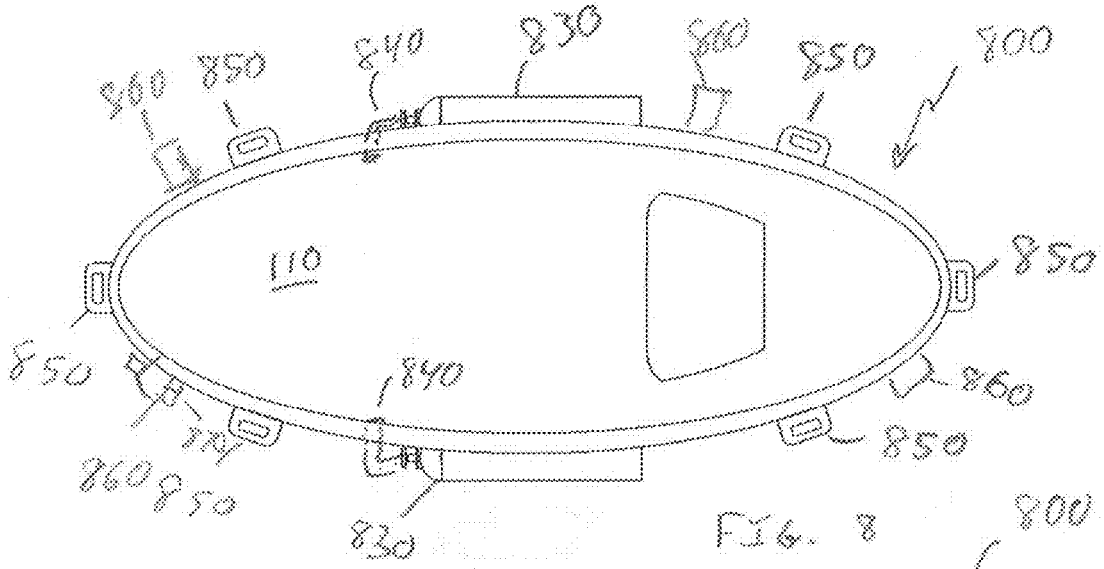
FIG. 8 illustrates a top view of an embodiment of a swimming apparatus according to the present invention.
Figure 9:
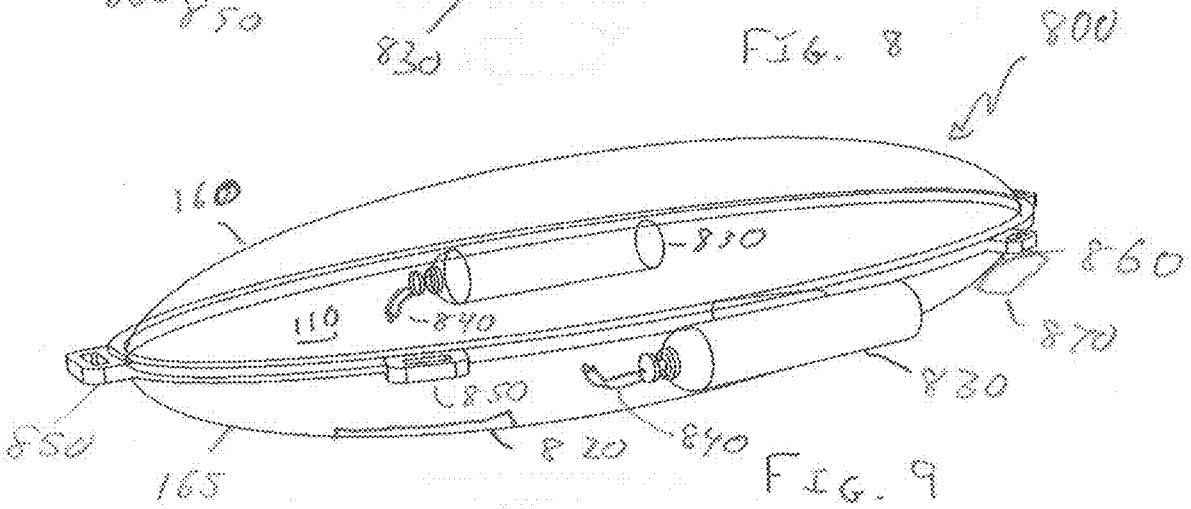
FIG. 9 illustrates a perspective view of an embodiment of a swimming apparatus according to the present invention.
Figure 10:
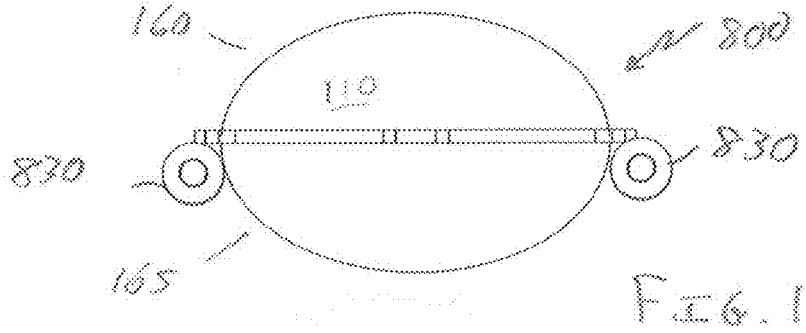
FIG. 10 illustrates a front view of a swimming apparatus according to the present invention.

As illustrated in FIGS. 7A-7B, the swimming apparatuses 100 can be connected together, by connector assemblies, such as 700A and 700B, the connector assemblies optionally including a propulsion assembly. In some embodiments, a group of swimming apparatus can be connected for a guided narrated tour of some place. The group of swimming apparatus can be connected to a boat or any other means of pulling them, such as with tow lines 710. In some embodiments, a vehicle can be in contact with a person on shore, a friend, a parent, or a tour manager. In some embodiments, the swimming apparatus's window ledge provides support for a mobile phone to be in clear view of the swimmer. The swimming apparatus may be equipped with a mobile antenna above the water surface to access mobile phone networks, GPS signal, and any other microwave signal generally accessible on land. The swimmer may use a waterproof mobile device to capture the GPS location of the swimming apparatus and monitor its position and travel course. The swimming apparatus with GPS locating capability may be tracked from a parent on shore or from a group operator to monitor location and direction of one or more vehicles. In some embodiments, video may be transmitted live through the communication channel through mobile device of custom equipment. The internet may be accessible while snorkeling with a communication channel installation on the apparatus.

Some embodiments include the top part disconnecting from the bottom part, flipping one around and inserting one into the other. The reduced height parts can then be carried in a carry bag for transport. All fins and attachments are removable. Some embodiment can have the top part made of flexible material that can be flipped to become concave and concentric to the bottom part in order to reduce the total height and be carried in a case/bag.

As discussed above, the swimming apparatus 100 can be used as a surface craft and for snorkeling, where the user 210 is floating in the water. The apparatus 100 optionally provides security of having a structure about the user 210 as well as optional buoyancy. The user may breathe through a standard snorkel tube and mask, drawing fresh air from the atmosphere. The apparatus 100 provides additional surface stability to hold the snorkel above the water line, such as via the optional snorkel mount 130. The apparatus 100 also can be used by a diver 210, wearing a scuba tank, an air regulator and a mask. In this case, the snorkel is not needed or is optional.

In this "dry" alternative embodiment, a swimming apparatus 100, 800 (also called "rescue swimming apparatus") is provided, such as with the embodiment discussed above in which the interior 110 of the swimming apparatus 100, 800 may be substantially dry such as substantially sealed from intrusion of water. In one embodiment, the interior 110 is not completely sealed but an optional opening 820 is at the bottom side of the apparatus. In this fashion, pressurized air can be added to the body 110 of the apparatus 800 to push out the water and create an air space for a user 210 in the interior 110. For rescue purposes, one or more divers can tow the apparatus underwater to bring a person 210 thru the water without the need of scuba equipment. This can then be used for rescue scenarios when dealing with persons that are not able to swim or scuba dive, or that are incapacitated.

In an embodiment in which the interior space 110 is not completely sealed. Pressurized air is supplied to the interior 110, such as from an air supply that includes air tanks 830 that may be externally or internally mounted to the swimming apparatus 800, and optionally supplied to the interior via air hose(s) 840 to the interior 110 from the air tank(s) 830. It should be noted that the air supply 840 may be air of a similar mixture as atmospheric air or alternatively may be oxygen, or high oxygen fluid, or other mixture that is breathable by the swimmer. In another embodiment air is provided into the interior via one or more hoses 840 from any external source. Pressurized air inside the apparatus acts to create a pressure gradient, pushing water that may intrude into the "dry" interior out through the bottom opening 820 or through any other desired port. The air pressure inside the space 110 is desired to be at the same as or greater than the pressure of the surrounding the water. This is called ambient pressure air, like scuba divers use.

In this dry interior embodiment, the swimmer 210 optionally may wear a mask, fins or other scuba gear, but it is not required, so long as a breathable atmosphere is maintained in the interior 110. One or more pressure tanks 830 (or other source, such as an air hose) is used to fill the chamber with sufficient air to evacuate the water. Continuous flow also insures that water is kept out and a fresh air flow to maintain the proper oxygen level. Alternately, two or more air tanks 830 can be used, one to blow the water out of the chamber and the second connected to a face mask for breathing, if so desired. In this scenario, if the user takes off the mask or drops it, he/she can still breathe normally inside the chamber space.

The dry or rescue embodiment of the swimming apparatus 100, 800 optionally can be powered, with a propulsion system such as described above (for example, 600A, 600B, 600C, 600D, 600E) to help it transit underwater. It can be equipped with a headset to communicate with the divers outside. One or more optional handles 850 are provided for external engagement, such as to assist divers to maneuver the apparatus 800 underwater. In addition, ballast weights 870, such as scuba diver weights or any suitable ballast, can be attached to the apparatus 100, 800, to balance the buoyancy of the apparatus to make it neutrally buoyant. Exemplary ballast weights 870 and ballast attachment points 860 are illustrated in the figures, but it should be understood that any suitable ballast or ballast attachment apparatus may be used to achieve desired buoyancy characteristics.

The swimming apparatus 100, 800 can be opaque and flexible or hard, or it can be clear and solid, providing a rigid chamber that allows all parties to see each other and know the condition of the person inside.

While the embodiments are susceptible to various modifications and alternative forms, specific examples thereof have been shown in the drawings and are herein described in detail. It should be understood, however, that these embodiments are not to be limited to the particular form disclosed, but to the contrary, these embodiments are to cover all modifications, equivalents, and alternatives falling within the spirit of the disclosure. Furthermore, any features, functions, steps, or elements of the embodiments may be recited in or added to the claims, as well as negative limitations that define the inventive scope of the claims by features, functions, steps, or elements that are not within that scope.

What is claimed is:

1. A swimming apparatus comprising:

an exterior shell defining an entry aperture and an interior space accommodating a swimmer; and a propulsion system adapted to moving the swimming apparatus within a fluid, the propulsion system including:

a force input apparatus receiving a propulsive force from the swimmer's hands or feet;

a linkage assembly transmitting the force input;

a propulsion drive receiving the force input from the linkage assembly, the propulsion drive selected from a group including swim fins, paddles and a propeller; and a fin aperture accommodating the swim fins drivably connected to a drive mechanism or the swimmer, at least partially within the interior space, wherein the swim fins are attached to the swimmer.

2. The swimming apparatus according to claim 1 wherein the exterior shell is a single piece.

3. The swimming apparatus according to claim 1 wherein the exterior shell includes a first portion and a second portion, the first and second portions affixed to one another.

4. The swimming apparatus according to claim 1 wherein the force input apparatus includes a pedal.

5. The swimming apparatus according to claim 1 wherein the force input apparatus includes a crank.

6. The swimming apparatus according to claim 1 wherein the propulsion system includes swim fins.

7. The swimming apparatus according to claim 1 wherein the propulsion drive includes swim fins.

8. The swimming apparatus according to claim 1 wherein the exterior shell defines an enclosed interior space.

9. The swimming apparatus according to claim 1 wherein: the exterior shell includes an aperture at its bottom;

an air supply input providing air into the interior space defined within the swimming apparatus.

10. A swimming apparatus comprising:

an exterior shell defining an entry aperture and an interior space accommodating a swimmer;

an air supply input providing air into the interior space defined within the swimming apparatus; and a fin aperture accommodating external fins drivably connected to a drive mechanism or the swimmer, at least partially within the interior space, wherein the external fins are attached to the swimmer.

11. The swimming apparatus according to claim 10 wherein the air supply input provides air into the interior space at a pressure that is above surrounding fluid pressure.

12. The swimming apparatus according to claim 10 wherein the exterior shell defines an aperture at or adjacent a bottom side.

13. The swimming apparatus according to claim 12 wherein the air supply input provides air into the interior space at a pressure that is above the surrounding fluid pressure.

14. A swimming apparatus comprising:

an exterior shell defining an entry aperture and an interior space accommodating a swimmer; and a fin aperture accommodating external fins drivably connected to a drive mechanism or the swimmer, at least partially within the interior space, wherein the external fins are attached to the swimmer.

15. The swimming apparatus of claim 14 wherein the external fins are connected to a linkage assembly, the linkage assembly connected to a force input, the force input including at least one of the swimmer or a motor.

* * * * *